US006107970A

United States Patent [19]

Holshouser et al.

[11] Patent Number: 6,107,970

[45] Date of Patent: Aug. 22, 2000

[54] INTEGRAL ANTENNA ASSEMBLY AND HOUSING FOR ELECTRONIC DEVICE

[75] Inventors: Howard E. Holshouser, Efland; Gerard J. Hayes, Wake Forest, both of N.C.

[73] Assignee: Ericsson Inc., Research Triangle Park, N.C.

[21] Appl. No.: 09/167,758

[22] Filed: Oct. 7, 1998

[51] Int. Cl.[7] ..... H01Q 1/24; H01Q 5/00; H01Q 21/30

[52] U.S. Cl. ..... 343/702; 343/895; 455/575; 455/90; 455/272

[58] Field of Search ..... 343/702, 895; 455/82, 90, 269, 280, 272, 351, 575; H01Q 1/24, 5/00, 21/30

[56] References Cited

U.S. PATENT DOCUMENTS 5,668,559 9/1997 Baro ..... 343/702
5,894,292 4/1999 Everest et al. ..... 343/702
5,918,189 6/1999 Kivela ..... 343/702
5,990,838 11/1999 Burns et al. ..... 343/702

*Primary Examiner*—Michael C. Wimer
*Attorney, Agent, or Firm*—Myers Bigel Sibley & Sajovec, P.A.

[57] ABSTRACT

A radiotelephone housing includes an antenna enclosure extending outwardly therefrom having an internal passage configured to receive an internally-mounted antenna therewithin. The antenna enclosure is integrally formed with the radiotelephone housing such that an antenna secured therewithin is protected from damage caused by impact forces to the radiotelephone. An electronic substrate hosting a transceiver preferably includes an antenna extending from an end portion thereof that is configured to be inserted within the antenna enclosure. A coaxial connector or other electromechanical connecting device is not required for connecting the antenna to the transceiver.

42 Claims, 5 Drawing Sheets

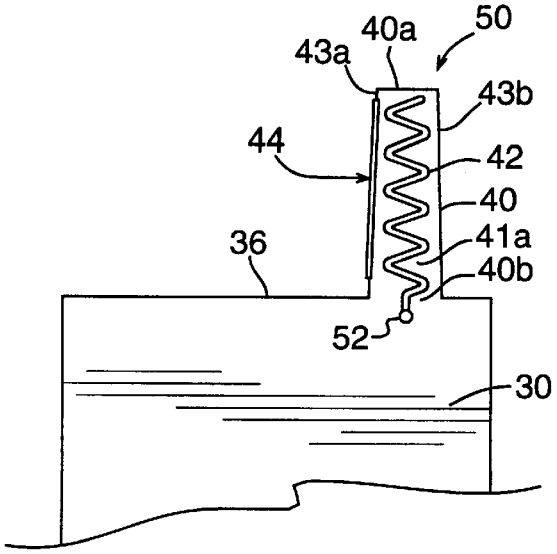
FIG. 3
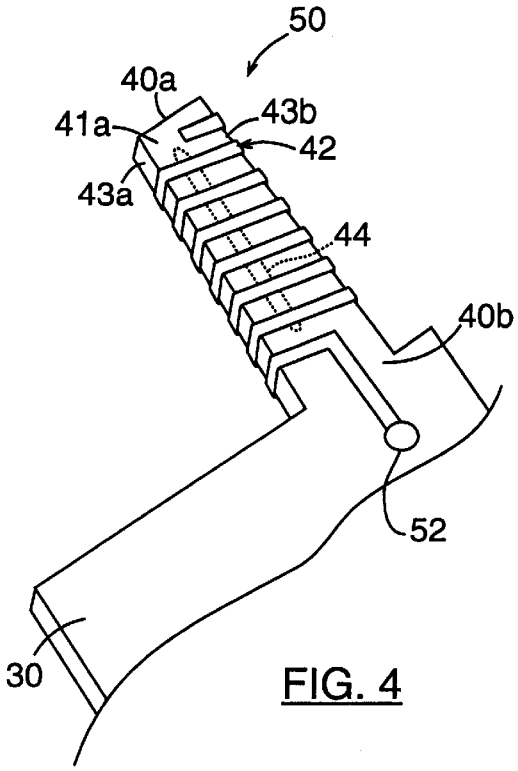
FIG. 4
FIG. 5A
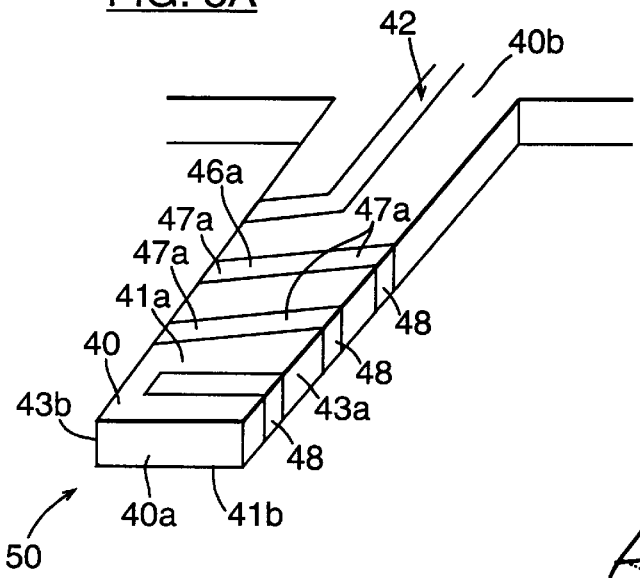
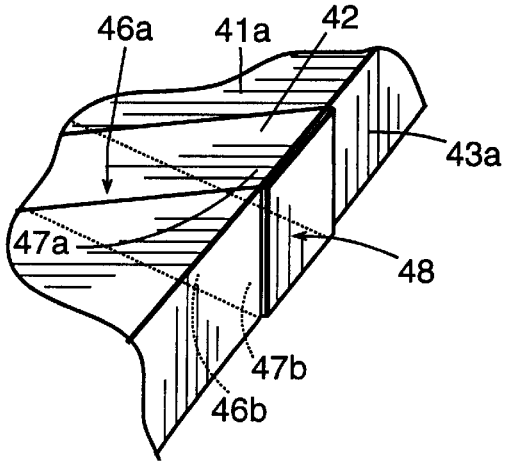
FIG. 5B

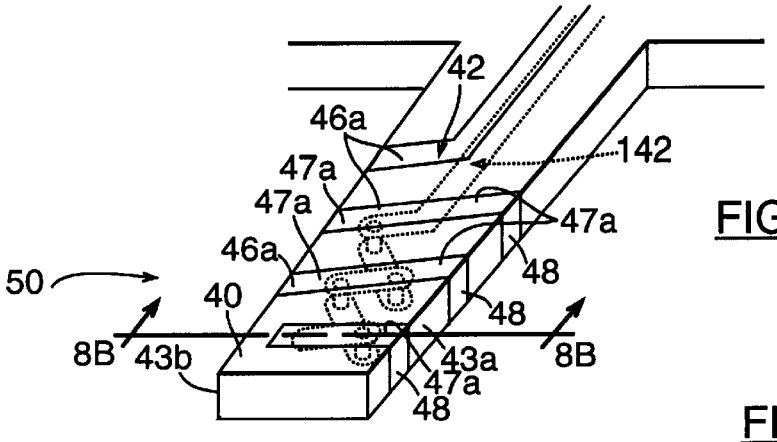
FIG. 8A
FIG. 8B
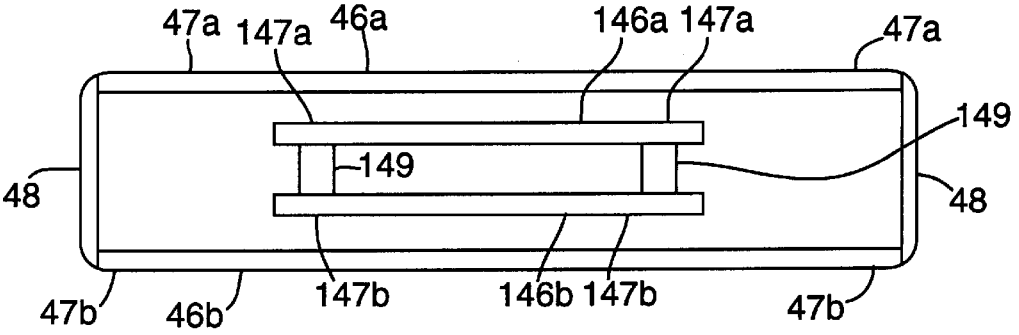
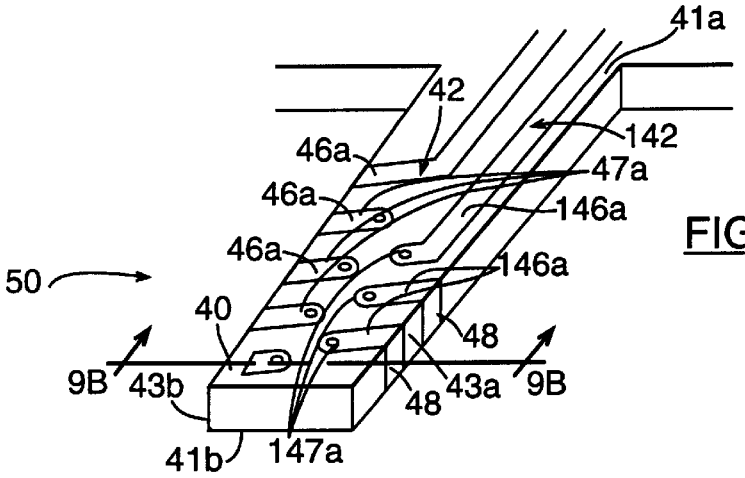
FIG. 9A
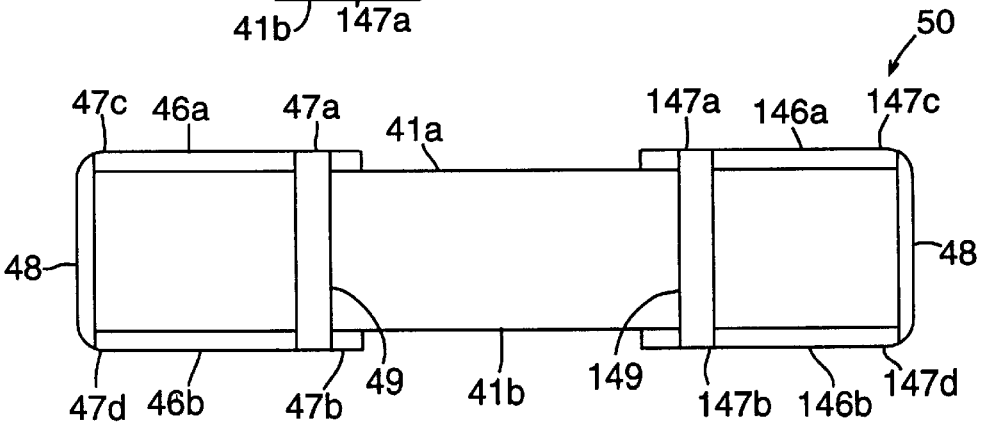
FIG. 9B

INTEGRAL ANTENNA ASSEMBLY AND HOUSING FOR ELECTRONIC DEVICE

FIELD OF THE INVENTION

The present invention relates generally to radiotelephones and, more particularly, to radiotelephone antennas.

BACKGROUND OF THE INVENTION

Radiotelephones generally refer to communications terminals which provide a wireless communications link to one or more other communications terminals. Radiotelephones may be used in a variety of different applications, including cellular telephone, land-mobile (e.g., police and fire departments), and satellite communications systems.

Many radiotelephones, particularly handheld radiotelephones, employ externally-mounted antennas. Externally-mounted antennas are conventionally connected to internal radio frequency (RF) circuitry (i.e., a transceiver) via a coaxial connector, or other electro-mechanical device. Unfortunately, these connecting devices may contribute to a loss of RF signal strength. In addition, these connecting devices may be somewhat expensive, thereby adding to the manufacturing costs of radiotelephones. An externally-mounted antenna and its connector may be subject to damage or failure when a radiotelephone is dropped or subjected to other impact forces. Furthermore, mechanical portions of these connectors may become unreliable over time.

Efforts to eliminate externally mounted antennas have met with limited success, however. An antenna that is incorporated entirely within a radiotelephone housing may be a poor radiator because of the close proximity of the antenna to various electronic components within the radiotelephone, and because of the close proximity of the antenna to the body of a user. Close proximity of an antenna to internal electronic components and to the body of a user during operation of a radiotelephone may result in degraded signal quality or fluctuations in signal strength.

Efforts to develop internally-mounted antennas have also been affected by the current trend of radiotelephone miniaturization. Indeed, many contemporary radiotelephones are only 11–12 centimeters in length. As radiotelephones decrease in size, the amount of internal space therewithin may be correspondingly reduced. A reduced amount of internal space may make it difficult for internally-mounted antennas to achieve sufficient bandwidth and gain necessary for radiotelephone operation in single or multiple frequency bands because antenna size may be correspondingly reduced.

SUMMARY OF THE INVENTION

It is, therefore, an object of the present invention to provide antennas that can extend from the housing of a electronic device, such as a radiotelephone, without requiring electro-mechanical connectors to connect an antenna to internal RF circuitry.

It is another object of the present invention to facilitate the reduction of radiotelephone manufacturing costs.

It is another object of the present invention to provide antenna systems for electronic devices, such as a radiotelephones, that can be resistant to damage and failure resulting from impact forces.

It is another object of the present invention to provide antennas that can operate within multiple frequency bands with adequate gain for use with small personal communication devices such as radiotelephones.

These and other objects of the present invention are provided, according to the present invention, by a housing for an electronics device, such as a radiotelephone, that includes an antenna enclosure extending outwardly therefrom, and that includes an internal passage configured to receive an internally-mounted antenna therewithin. Preferably, the antenna enclosure is integrally formed with the radiotelephone housing such that an antenna secured therewithin is protected from damage caused by impact forces to the radiotelephone housing. An electronic substrate hosting a transceiver preferably includes an antenna extending from an end portion thereof and that is in electrical communication with the transceiver.

According to one aspect of the present invention, an antenna may include a dielectric member integrally formed with a printed circuit board disposed within the radiotelephone housing that includes a first conductive element. The first conductive element is in electrical communication with a transceiver and is configured to resonate within a first frequency band. A second conductive element may be provided in spaced-apart relationship with the first conductive element. The second conductive element may be parasitically coupled with the first conductive element and configured to resonate within a second frequency band different from the first frequency band. The second conductive element may be disposed on or within the dielectric member in spaced-apart relationship with the first conductive element and in electrical communication with the receiver transceiver.

Conductive elements utilized with an antenna according to the present invention may have various shapes and configurations. According to one embodiment, spaced apart edge portions of conductive traces may be joined together using conductive edge plating strips along the sides of a dielectric member to form a continuous conductive element configured to resonate within a predetermined frequency band. According to another embodiment, spaced apart edge portions of conductive traces may be joined together using conductive vias to form a continuous conductive element configured to resonate within a predetermined frequency band. Portions of conductive traces may be disposed on the surfaces of a dielectric member. In addition, portions of conductive traces may be disposed between layers of the dielectric member.

Electronic devices, such as radiotelephones, incorporating antennas according to the present invention are advantageous because the need to connect an externally-mounted antenna to an internally-mounted receiver (or transceiver) via various mechanical parts, which may become damaged or unreliable over time, may be eliminated. Furthermore, antennas according to the present invention can be less vulnerable to interference caused by the body of a user, or by internal electronic components.

BRIEF DESCRIPTION OF THE DRAWINGS

The accompanying drawings, which are incorporated in and constitute a part of the specification, illustrate embodiments of the invention and, together with the description, serve to explain principles of the invention.

FIG. 3 illustrates a dielectric member integrally formed with, and extending from, an electronic substrate, and including a first meandering conductive element and an adjacent parasitic conductive element, according to an embodiment of the present invention.

FIG. 4 illustrates a dielectric member integrally formed with, and extending from, an electronic substrate, and including a first helical conductive element extending therearound and a parasitic conductive element disposed therewithin, according to an embodiment of the present invention.

FIG. 5A illustrates an antenna, according to another embodiment of the present invention, wherein a dielectric member is integrally formed with, and extends from, an electronic substrate and includes a helical conductive element extending therearound.

FIG. 5B is an enlarged view of the antenna of FIG. 5A illustrating a conductive edge plating strip joining spaced-apart ends of conductive traces along the dielectric member sides.

FIG. 8A illustrates an antenna, according to another embodiment of the present invention, wherein a dielectric member is integrally formed with, and extends from, an electronic substrate and includes a helical conductive element disposed therearound and a helical conductive element disposed therewithin.

FIG. 8B is a cross-sectional view of the antenna of FIG. 8A taken along lines 8B—8B.

FIG. 9A illustrates an antenna, according to another embodiment of the present invention, wherein a dielectric member is integrally formed with, and extends from, an electronic substrate and includes two helical conductive elements in an adjacent configuration.

FIG. 9B is a cross-sectional view of the antenna of FIG. 9A taken along lines 9B—9B.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
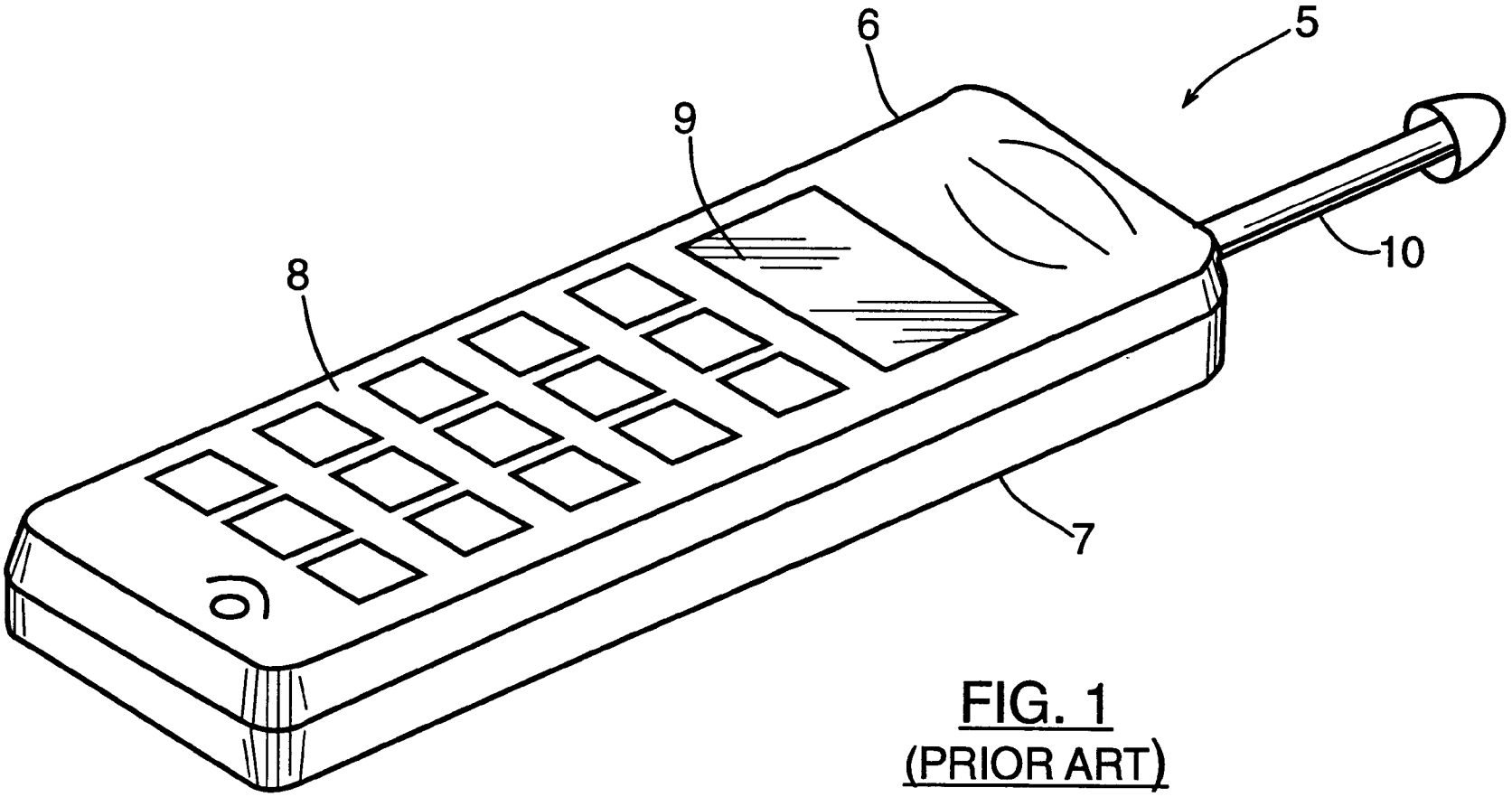
FIG. 1 (PRIOR ART)
FIG. 1 illustrates a radiotelephone with an antenna externally mounted to the housing of a radiotelephone.

Referring now to FIG. 1, a conventional radiotelephone handset 5 includes a housing 7 that encloses a transceiver (not shown) for transmitting and receiving telecommunications signals, as is known to those skilled in this art. A keypad 8, display window 9, and antenna 10 for receiving telecommunications signals, facilitate radiotelephone operation. Other elements of radiotelephones are conventional and need not be described herein.

As is known to those skilled in the art of communications devices, an antenna is a device for transmitting and/or receiving electrical signals. A transmitting antenna typically includes a feed assembly that induces or illuminates an aperture or reflecting surface to radiate an electromagnetic field. A receiving antenna typically includes an aperture or surface focusing an incident radiation field to a collecting feed, producing an electronic signal proportional to the incident radiation. The amount of power radiated from or received by an antenna depends on its aperture area and is described in terms of gain. Radiation patterns for antennas are often plotted using polar coordinates. Voltage Standing Wave Ratio (VSWR) relates to the impedance match of an antenna feed point with a feed line or transmission line of a communications device, such as a radiotelephone.

Conventional radiotelephones employ an antenna which is electrically connected to a transceiver operably associated with a signal processing circuit positioned on an internally disposed printed circuit board. To radiate RF energy with minimum loss, or to pass along received RF energy to a radiotelephone transceiver with minimum loss, the transceiver and the antenna are preferably interconnected such that their respective impedances are substantially "matched" (i.e., electrically tuned to filter out or compensate for undesired antenna impedance components) to provide a 50 Ohm (Ω) (or desired) impedance value at the circuit feed.

Figure 2A:
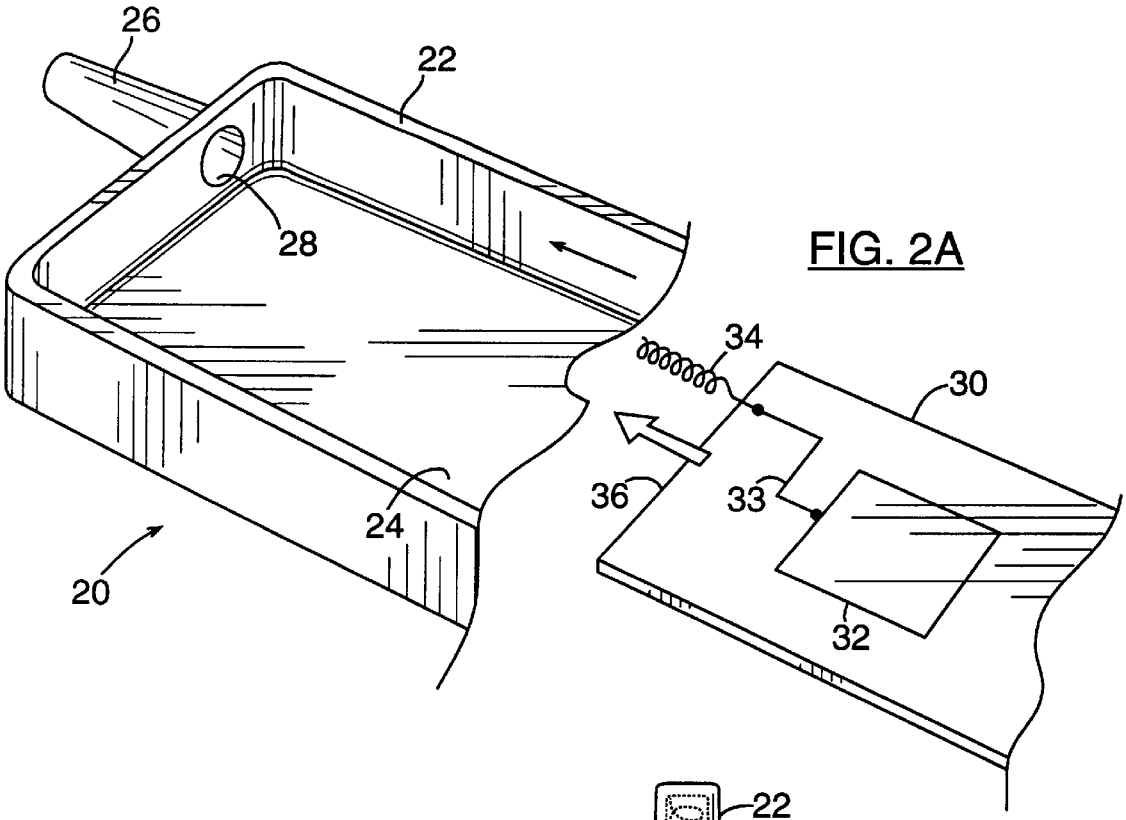
FIGS. 2A and 2B illustrate an antenna system according to the present invention including an integral housing appendage that is configured to house an antenna directly connected to internal RF circuitry.
Figure 2B:
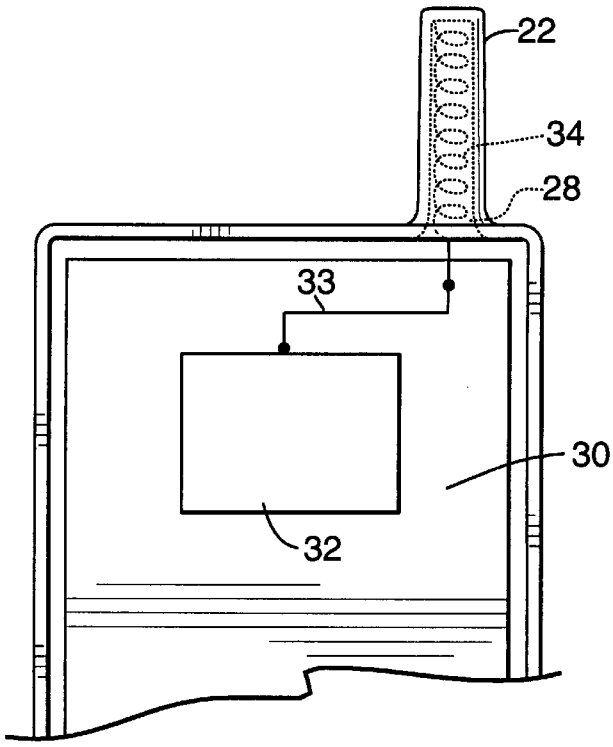

Referring now to FIGS. 2A–2B, an antenna system according to an aspect of the present invention is illustrated. An electronic device 20, such as a radiotelephone, includes a housing 22 that defines an internal cavity 24 for hosting electronic components for receiving and/or transmitting telecommunications signals (hereinafter referred to collectively as a "transceiver"). An antenna enclosure 26 is integrally formed with, and extends outwardly from, the housing 22, as illustrated. The antenna enclosure 26 defines an internal passage 28 that is in communication with the internal cavity 24.

An electronic substrate 30, such as a printed circuit board hosting a transceiver 32, includes an antenna 34 extending from an end 36 of the electronic substrate 30, as illustrated. The antenna 34 is in direct electrical communication with the transceiver 32 via electrical path 33, without requiring a coaxial or other electro-mechanical connector. The electronic substrate 30 is configured to be disposed within the internal cavity 24 such that the antenna 34 extends within the antenna enclosure 26 when in an assembled configuration, as illustrated in FIG. 2B. The present invention provides the advantages of an externally mounted antenna while eliminating the need for a mechanical connector between the antenna 34 and the transceiver 32. Furthermore, the antenna 34 is protected against damage caused by impact forces to the radiotelephone 20. In the illustrated embodiment of FIGS. 2A and 2B, the antenna 34 is a helical coil. However, according to other embodiments of the present invention, an antenna may be formed from a dielectric member that extends from an end of a printed circuit board hosting a transceiver.

Various embodiments of a radiotelephone antenna 50, according to the present invention, are illustrated in FIGS. 3–10B. In each of the antenna embodiments of FIGS.

3–10B, one or more radiating elements are disposed on or within a dielectric member 40 and are configured to resonate within selected frequency bands. Each of the illustrated radiating elements is in direct electrical communication with the transceiver 32, with no intermediate electro-mechanical connector.

In each of the antenna embodiments of FIGS. 3–10B, the illustrated dielectric member 40 has an elongated, generally rectangular configuration with opposite first and second end portions 40*a* 40*b*, opposite first and second faces 41*a*, 41*b*, and opposite first and second elongated side portions 43*a*, 43*b*. However, it is to be understood that antennas incorporating aspects of the present invention may have various configurations and shapes, and are not limited to the illustrated configuration.

The dielectric member 40 in each of the embodiments of FIGS. 3–10B is preferably molded or formed from a polymeric, dielectric material, such as fiberglass, nylon and the like. However, various dielectric materials may be utilized for the dielectric member 40 without limitation. The dielectric member may be formed from a multi-layered dielectric material such as an FR4 board, which is well known to those skilled in this art.

Preferably, the dielectric member 40 has a dielectric constant of between about 4.4 and about 4.8. However, it is to be understood that dielectric members utilized as antennas according to the present invention may have different dielectric constants without departing from the spirit and intent of the present invention. Dimensions of the illustrated dielectric member 40 may vary depending on the space limitations of a radiotelephone or other communications device within which the dielectric member 40 is to be incorporated as an antenna.

Referring to FIG. 3, a dielectric member 40 extends from an end 36 of an electronic substrate 30. A first conductive element 42, such as a copper trace, has a meandering configuration along a face 40*a* of the dielectric member 40 and serves as a radiating element configured to resonate within a first frequency band. The first conductive element 42 is in electrical communication with a transceiver, as described above. Together, the dielectric substrate 40 and first conductive element 42 serve as an antenna 50 for an electronic device, such as a radiotelephone. Preferably, the antenna 50 is interconnected with a transceiver such that their respective impedances are substantially matched to provide a 50 Ω (or desired) impedance value at the circuit feed 52.

A second conductive element 44, such as a copper trace, is disposed along an edge portion 43*a* of the dielectric member 40 in spaced-apart relationship with the first conductive element 42. The second conductive element 44 is parasitically coupled with the first conductive element and serves as a radiating element configured to resonate within a second frequency band different from the first frequency band. The second conductive element 44 may be positioned in various locations on the dielectric member 40, and is not limited to the illustrated position.

As is known to those skilled in the art, parasitic electromagnetic elements are coupled to, and "feed off", near-field currents (i.e., currents flowing on a conductive surface exist in a "field" of electromagnetic fields that the currents induce in close proximity to the conductive surface). A parasitic conductive element is not driven directly by an RF source, but rather, is excited by energy radiated by another source. The presence of a parasitic conductive element may change the resonant characteristics of a nearby conductive element serving as an antenna.

Referring to FIG. 4, a first conductive element 42, such as a conductive trace, has a helical configuration around the illustrated dielectric member 40. The first conductive element 42 serves as a radiating element and is in electrical communication with a transceiver, as described above. Preferably, the antenna 50 is interconnected with a transceiver such that their respective impedances are substantially matched to provide a 50 Ω (or desired) impedance value at the circuit feed 52.

A second conductive element 44, such as a copper trace, is disposed within the dielectric member 40 between adjacent layers of the multi-layered dielectric member 40. The second conductive element 44 serves as a radiating element that is parasitically-coupled with the first conductive element 42 and that is configured to resonate within a second frequency band different from the first frequency band.

In each of the embodiments of FIGS. 3–10B, the conductive elements are preferably copper traces. However, other conductive materials may be utilized. Each of the conductive elements serve as radiating elements that are configured to receive and/or transmit radiotelephone communication signals. Preferably, each of the conductive elements are configured to resonate as quarter-wave antennas, or multiples thereof, such as half-wave antennas, and the like. The length of each conductive element is a tuning parameter, as is known to those skilled in the art of antennas. Furthermore, conductive elements utilized in accordance with the present invention may have various shapes and configurations and are not limited to the illustrated embodiments.

Referring to FIGS. 5A–5B, an antenna 50 configured for single frequency band operation, according to an embodiment of the present invention, is illustrated. The illustrated dielectric member 40 includes a helical conductive element 42 disposed therearound, as illustrated. The conductive element 42 is in electrical communication with the transceiver of a radiotelephone, as described above. The conductive element 42 includes conductive traces 46*a* and 46*b* disposed on respective faces 41*a*, 41*b* of the dielectric member 40. Conductive edge plating strips 48 join the spaced-apart ends 47*a*, 47*b* of the conductive traces 46*a*, 46*b* along the dielectric member sides 43*a*, 43*b*, as illustrated, to form a continuous, helical conductive element 42 configured to resonate within a predetermined frequency band.

Figure 6A:
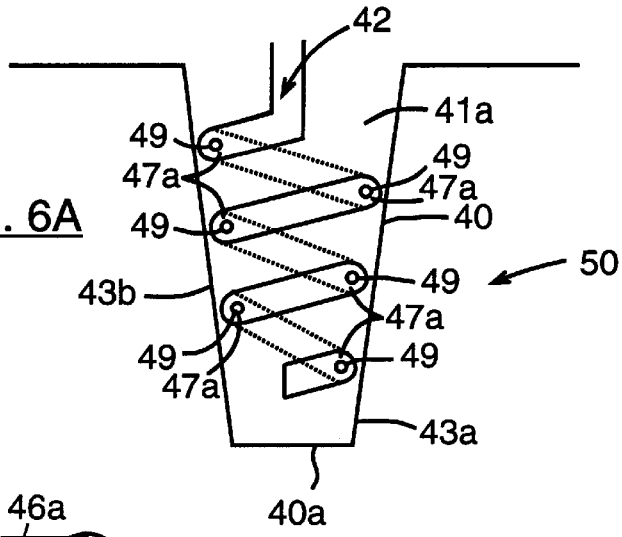
FIG. 6A illustrates an antenna, according to another embodiment of the present invention, wherein a dielectric member is integrally formed with, and extends from, an electronic substrate and includes a helical conductive element.
Figure 6B:
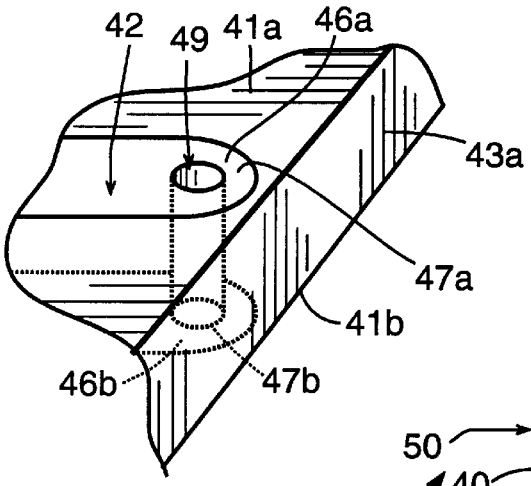
FIG. 6B is an enlarged view of the antenna of FIG. 6A illustrating a conductive via joining spaced-apart ends of conductive traces adjacent the dielectric member sides.
Figure 7A:
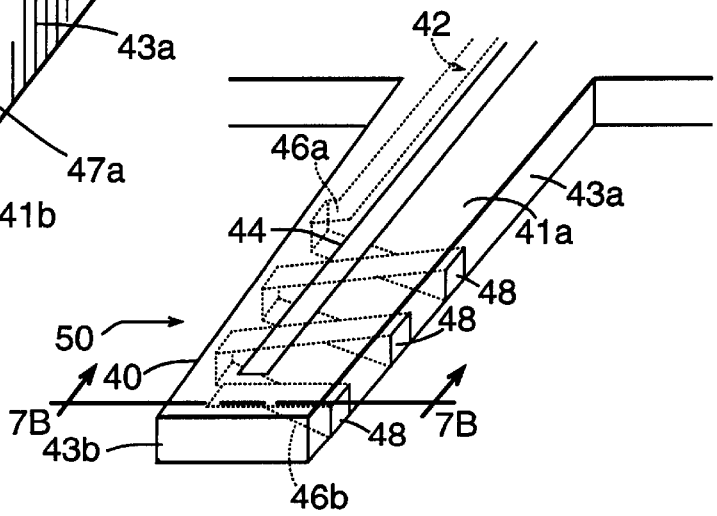
FIG. 7A illustrates an antenna, according to another embodiment of the present invention, wherein a dielectric member is integrally formed with, and extends from, an electronic substrate and includes a helical conductive element with portions extending between layers of the dielectric member, and with a parasitic conductive element disposed along a surface thereof.
Figure 7B:
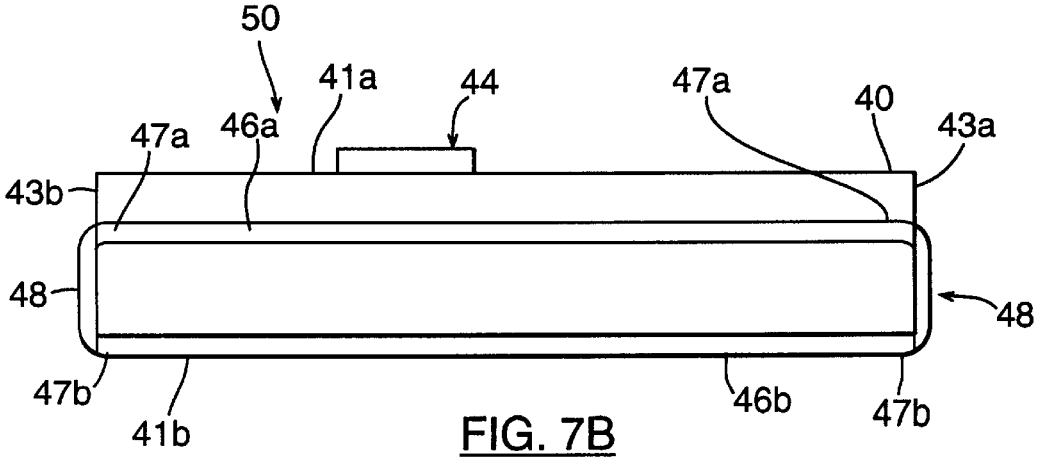
FIG. 7B is a cross-sectional view of the antenna of FIG. 7A taken along lines 7B—7B.

Referring to FIGS. 6A–6B, an antenna 50 configured for single frequency band operation, according to another embodiment of the present invention, is illustrated. The illustrated dielectric member 40 includes a helical conductive element 42 having conductive traces 46*a* and 46*b* disposed on respective faces 41*a*, 41*b* of the dielectric member 40. Conductive vias 49 join the spaced-apart ends 47*a*, 47*b* of the conductive traces 46*a*, 46*b* adjacent the dielectric member sides 43*a*, 43*b*, as illustrated, to form a continuous, helical conductive element 42 configured to resonate within a predetermined frequency band. The conductive element 42 is in electrical communication with a transceiver a radiotelephone. Referring to FIGS. 7A–7B, an antenna 50 configured for multiple frequency band operation, according to another embodiment of the present invention, is illustrated. The illustrated dielectric member 40 is multi-layered and includes a first conductive element 42 having conductive traces 46*a* disposed between adjacent layers of the multi-layered dielectric member 40, and conductive traces 46*b* disposed on the face 41*b* of the dielectric member 40, as illustrated. Conductive edge plating strips 48 join the spaced-apart ends 47*a*, 47*b* of the conductive traces 46*a*, 46*b* along the dielectric member sides 43*a*, 43*b*, as illustrated, to form a continuous, helical conductive element 42 configured to resonate within a predetermined frequency band. The conductive element 42 is in electrical communication with a transceiver of a radiotelephone.

Alternatively, conductive vias may be utilized, as described above, to join the spaced-apart ends 47*a*, 47*b* of the conductive traces 46*a*, 46*b* adjacent the dielectric member sides 43*a*, 43*b* to form a continuous, helical conductive element 42.

An elongated second conductive element 44, such as a copper trace, is disposed on the surface 41*a* of the dielectric member 40, as illustrated. The second conductive element 44 serves as a radiating element that is parasitically-coupled with the first conductive element 42 and that is configured to resonate within a second frequency band different from the first frequency band.

In the illustrated embodiment of FIGS. 7A–7B, the second conductive element 44 is oriented generally parallel with the sides 43*a*, 43*b* of the dielectric member 40. However, it is understood that the second conductive element 44 may have various shapes and configurations. Similarly, the first conductive element 42 may have various shapes and configurations, and is not limited to the illustrated helical configuration.

Referring to FIGS. 8A–8B, an antenna 50 configured for multiple frequency band operation, according to another embodiment of the present invention, is illustrated. The illustrated dielectric member 40 is multi-layered and includes a first helical conductive element 42 disposed therearound, as illustrated. The first conductive element 42 is in electrical communication with a transceiver of a radiotelephone. The first conductive element 42 includes conductive traces 46*a* and 46*b* disposed on respective faces 41*a*, 41*b* of the dielectric member 40. Conductive edge plating strips 48 join the spaced-apart ends 47*a*, 47*b* of the conductive traces 46*a*, 46*b* along the dielectric member sides 43*a*, 43*b*, as illustrated, to form a continuous, helical conductive element 42 configured to resonate within a first predetermined frequency band.

The illustrated dielectric member 40 also includes a second helical conductive element 142 disposed therewithin, as illustrated. The second conductive element 142 is also in electrical communication with the transceiver of the radiotelephone. The second conductive element 142 includes conductive traces 146*a* and 146*b* disposed between respective spaced-apart layers of the multi-layered dielectric member 40. Conductive vias 149 are utilized to join the spaced-apart ends 147*a*, 147*b* of the conductive traces 146*a*, 146*b*, as illustrated, to form a continuous, helical conductive element 142 within the dielectric member 40. The second helical conductive element 142 is configured to resonate within a second frequency band, different from the first frequency band.

The first and second conductive elements 42 and 142 are not limited to the illustrated helical configurations. Both the first and second conductive elements 42, 142 may have various shapes and configurations.

Referring to FIGS. 9A–9B, an antenna 50 configured for multiple frequency band operation, according to another embodiment of the present invention, is illustrated. The illustrated dielectric member 40 includes a first helical conductive element 42 in electrical communication with the transceiver of an electronic device, such as a radiotelephone. The conductive element 42 includes conductive traces 46*a* and 46*b* disposed on respective faces 41*a*, 41*b* of the dielectric member 40, as illustrated. The conductive traces 46*a*, 46*b* extend across only a portion of each of the respective faces 41*a*, 41*b*, as illustrated.

Conductive vias 49 join the spaced-apart ends 47*a*, 47*b* of the conductive traces 46*a*, 46*b*, and conductive edge plating strips 48 join the spaced-apart ends 47*c*, 47*d* of the conductive traces 46*a*, 46*b* along the dielectric member side 43*b*, as illustrated, to form a continuous, helical conductive element 42 configured to resonate within a first frequency band.

The illustrated dielectric member 40 also includes a second helical conductive element 142 in electrical communication with the transceiver of the radiotelephone. The conductive element 142 includes conductive traces 146*a* and 146*b* disposed on respective faces 41*a*, 41*b* of the dielectric member 40, as illustrated. The conductive traces 146*a*, 146*b* extend across only a portion of each of the respective faces 41*a*, 41*b*, as illustrated. Conductive vias 149 join the spaced-apart ends 147*a*, 147*b* of the conductive traces 146*a*, 146*b*, and conductive edge plating strips 148 join the spaced-apart ends 147*c*, 147*d* of the conductive traces 146*a*, 146*b* along the dielectric member side 43*a*, as illustrated, to form a continuous, second helical conductive element 142 configured to resonate within a second frequency band, different from the first frequency band.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. An electronic device, comprising:

a housing defining an internal cavity for hosting electronic components therewithin;

a receiver that receives wireless communications signals disposed within said internal cavity;

an antenna in electrical communication with said receiver, said antenna comprising:

an elongated electronic substrate disposed within said internal cavity and having an end, wherein said elongated electronic substrate defines a longitudinal direction transverse to the end;

a dielectric member integrally formed with and extending from the end of said electronic substrate and along said longitudinal direction, said dielectric member comprising opposing faces, opposing side portions and a free end; and a first conductive element disposed on said dielectric member, said first conductive element in electrical communication with said receiver and configured to resonate within a first frequency band; and a second conductive element disposed on said dielectric member in spaced-apart relationship with said first conductive element, said second conductive element parasitically coupled with said first conductive element and configured to resonate within a second frequency band different from said first frequency band; and an antenna enclosure integrally formed with and extending outwardly from said housing, and including an internal passage in communication with said internal cavity, wherein said passage is configured to receive said antenna therewithin.

2. An electronic device according to claim 1 wherein said first conductive element has a meandering configuration.

3. An electronic device according to claim 1 wherein said first conductive element has a helical configuration around said dielectric member.

4. An electronic device according to claim 1 further comprising means for matching an impedance of said antenna to said receiver.

5. An electronic device according to claim 1 wherein said electronic substrate is a printed circuit board.

6. An antenna for a radiotelephone, comprising:

an elongated electronic substrate having an end, wherein said elongated electronic substrate defines a longitudinal direction transverse to the end, and wherein said elongated electronic substrate includes a transceiver disposed thereon that sends and receives radiotelephone communications signals;

a dielectric member integrally formed with and extending from the end of said electronic substrate and along said longitudinal direction, said dielectric member comprising opposing faces, opposing side portions and a free end;

a first conductive element disposed on said dielectric member, said first conductive element in electrical communication with said transceiver and configured to resonate within a first frequency band; and a second conductive element disposed on said dielectric member in spaced-apart relationship with said first conductive element, said second conductive element parasitically coupled with said first conductive element and configured to resonate within a second frequency band different from said first frequency band.

7. An antenna according to claim 6 wherein said first conductive element has a meandering configuration.

8. An antenna according to claim 6 wherein said first conductive element has a helical configuration around said dielectric member.

9. An electronic device according to claim 6 wherein said second conductive element has a helical configuration within said dielectric member.

10. An antenna according to claim 6 wherein said first conductive element comprises:

a first conductive portion disposed on one of said faces; and a second conductive portion disposed on another of said faces;

wherein said first and second conductive portions are electrically connected by at least one conductive via extending between said first and second conductive portions through said dielectric member.

11. A radiotelephone antenna, comprising:

an electronic substrate including a transceiver disposed thereon that sends and receives radiotelephone communications signals;

a dielectric member integrally formed with and extending from a portion of said electronic substrate, said dielectric member comprising opposing faces, opposing side portions and a free end;

a first conductive element disposed on said dielectric member, said first conductive element in electrical communication with said transceiver and configured to resonate within a first frequency band; and a second conductive element disposed within said dielectric member, said second conductive element parasitically coupled with said first conductive element and configured to resonate within a second frequency band different from said first frequency band.

12. A radiotelephone antenna according to claim 11 wherein said dielectric member comprises a multi-layered substrate and wherein said second conductive element is disposed between adjacent layers of said multi-layered substrate.

13. A radiotelephone antenna according to claim 11 wherein said first conductive element is disposed on said dielectric member in a helical configuration.

14. A radiotelephone antenna according to claim 12 wherein said first conductive element is disposed within said dielectric member in a helical configuration around one or more layers.

15. An electronic device, comprising:

a housing defining an internal cavity for hosting electronic components therewithin;

a receiver that receives wireless communication signals disposed within said internal cavity;

an antenna in electrical communication with said receiver, said antenna comprising:

an elongated electronic substrate disposed within said internal cavity and having an end, wherein said elongated electronic substrate defines a longitudinal direction transverse to the end;

a dielectric member integrally formed with and extending from the end of said electronic substrate and along said longitudinal direction, said dielectric member comprising opposing faces, opposing side portions and a free end;

a first conductive element disposed on said dielectric member, said first conductive element in electrical communication with said receiver and configured to resonate within a first frequency band; and a second conductive element disposed within said dielectric member, said second conductive element parasitically coupled with said first conductive element and configured to resonate within a second frequency band different from said first frequency band; and an antenna enclosure integrally formed with and extending outwardly from said housing, and including an internal passage in communication with said internal cavity, wherein said passage is configured to receive said antenna therewithin.

16. An electronic device according to claim 15 wherein said first conductive element has a meandering configuration.

17. An electronic device according to claim 15 wherein said first conductive element has a helical configuration around said dielectric member.

18. An electronic device according to claim 15 further comprising means for matching an impedance of said antenna to said receiver.

19. An electronic device according to claim 15 wherein said electronic substrate is a printed circuit board.

20. An electronic device, comprising:

a housing defining an internal cavity for hosting electronic components therewithin;

a receiver that receives wireless communications signals disposed within said internal cavity;

an antenna in electrical communication with said receiver, said antenna comprising:

an elongated electronic substrate disposed within said internal cavity and having an end, wherein said elongated electronic substrate defines a longitudinal direction transverse to the end;

a dielectric member integrally formed with and extending from the end of said electronic substrate and along said longitudinal direction, said dielectric member comprising opposing faces, opposing side portions and a free end;

a first conductive element disposed on said dielectric member, said first conductive element in electrical communication with said receiver and configured to resonate within a first frequency band; and a second conductive element disposed on said dielectric member in spaced-apart relationship with said first conductive element, said second conductive element in electrical communication with said receiver and configured to resonate within a second frequency band different from said first frequency band; and an antenna enclosure integrally formed with and extending outwardly from said housing, and including an internal passage in communication with said internal cavity, wherein said passage is configured to receive said antenna therewithin.

21. An electronic device according to claim 20 wherein said first conductive element has a meandering configuration.

22. An electronic device according to claim 20 wherein said first conductive element has a helical configuration around said dielectric member.

23. An electronic device according to claim 20 further comprising means for matching an impedance of said antenna to said receiver.

24. An electronic device according to claim 20 wherein said electronic substrate is a printed circuit board.

25. An electronic device, comprising:

a housing defining an internal cavity for hosting electronic components therewithin;

a receiver that receives wireless communications signals disposed within said internal cavity;

an antenna in electrical communication with said receiver, said antenna comprising:

an elongated electronic substrate disposed within said internal cavity and having an end, wherein said elongated electronic substrate defines a longitudinal direction transverse to the end;

a dielectric member integrally formed with and extending from the end of said electronic substrate and along said longitudinal direction, said dielectric member comprising opposing faces, opposing side portions and a free end; and a first conductive element disposed on said dielectric member, said first conductive element in electrical communication with said receiver and configured to resonate within a first frequency band; and a second conductive element disposed within said dielectric member, said second conductive element in electrical communication with said receiver and configured to resonate within a second frequency band different from said first frequency band; and an antenna enclosure integrally formed with and extending outwardly from said housing, and including an internal passage in communication with said internal cavity, wherein said passage is configured to receive said antenna therewithin.

26. An electronic device according to claim 25 wherein said first conductive element has a meandering configuration.

27. An electronic device according to claim 25 wherein said first conductive element has a helical configuration around said dielectric member.

28. An electronic device according to claim 25 further comprising means for matching an impedance of said antenna to said receiver.

29. An electronic device according to claim 25 wherein said electronic substrate is a printed circuit board.

30. An antenna for a radiotelephone, comprising:

an elongated electronic substrate having an end, wherein said elongated electronic substrate defines a longitudinal direction transverse to the end, and wherein said elongated electronic substrate includes a transceiver disposed thereon that sends and receives radiotelephone communications signals;

a dielectric member integrally formed with and extending from the end of said electronic substrate and along said longitudinal direction, said dielectric member comprising opposing faces, opposing side portions and a free end;

a first conductive element disposed on said dielectric member, said first conductive element in electrical communication with said transceiver and configured to resonate within a first frequency band; and a second conductive element disposed within said dielectric member, said second conductive element parasitically coupled with said first conductive element and configured to resonate within a second frequency band different from said first frequency band.

31. An antenna according to claim 30 wherein said first conductive element has a meandering configuration.

32. An antenna according to claim 30 wherein said first conductive element has a helical configuration around said dielectric member.

33. An antenna according to claim 30 wherein said first conductive element comprises:

a first conductive portion disposed on one of said faces; and a second conductive portion disposed on another of said faces;

wherein said first and second conductive portions are electrically connected by at least one conductive via extending between said first and second conductive portions through said dielectric member.

34. An antenna for a radiotelephone, comprising:

an elongated electronic substrate having an end, wherein said elongated electronic substrate defines a longitudinal direction transverse to the end, and wherein said elongated electronic substrate includes a transceiver disposed thereon that sends and receives radiotelephone communications signals;

a dielectric member integrally formed with and extending from the end of said electronic substrate and along said longitudinal direction, said dielectric member comprising opposing faces, opposing side portions and a free end;

a first conductive element disposed on said dielectric member, said first conductive element in electrical communication with said transceiver and configured to resonate within a first frequency band; and a second conductive element disposed on said dielectric member in spaced-apart relationship with said first conductive element, said second conductive element in electrical communication with said receiver and configured to resonate within a second frequency band different from said first frequency band.

35. An antenna according to claim 34 wherein said first conductive element has a meandering configuration.

36. An antenna according to claim 34 wherein said first conductive element has a helical configuration around said dielectric member.

37. An antenna according to claim 34 wherein said first conductive element comprises:

a first conductive portion disposed on one of said faces; and a second conductive portion disposed on another of said faces;

wherein said first and second conductive portions are electrically connected by at least one conductive via extending between said first and second conductive portions through said dielectric member.

38. An antenna for a radiotelephone, comprising:

an elongated electronic substrate having an end, wherein said elongated electronic substrate defines a longitudinal direction transverse to the end, and wherein said elongated electronic substrate includes a transceiver disposed thereon that sends and receives radiotelephone communications signals;

a dielectric member integrally formed with and extending from the end of said electronic substrate and along said longitudinal direction, said dielectric member comprising opposing faces, opposing side portions and a free end;

a first conductive element disposed on said dielectric member, said first conductive element in electrical communication with said transceiver and configured to resonate within a first frequency band; and a second conductive element disposed within said dielectric member, said second conductive element in electrical communication with said receiver and configured to resonate within a second frequency band different from said first frequency band.

39. An antenna according to claim 38 wherein said first conductive element has a meandering configuration.

40. An antenna according to claim 38 wherein said first conductive element has a helical configuration around said dielectric member.

41. An electronic device according to claim 38 wherein said second conductive element has a helical configuration within said dielectric member.

42. An antenna according to claim 38 wherein said first conductive element comprises:

a first conductive portion disposed on one of said faces; and a second conductive portion disposed on another of said faces;

wherein said first and second conductive portions are electrically connected by at least one conductive via extending between said first and second conductive portions through said dielectric member.

* * * * *